US005348060A

United States Patent [19]

Futagawa et al.

[11] Patent Number: 5,348,060

[45] Date of Patent: Sep. 20, 1994

[54] DRUG VESSEL

[75] Inventors: Hitoshi Futagawa, Kusatsu; Koji Ikeda, Osaka; Toshihiro Kikuchi, Suita, all of Japan

[73] Assignee: Nissho Corporation, Osaka, Japan

[21] Appl. No.: 917,942

[22] Filed: Jul. 24, 1992

[30] Foreign Application Priority Data

Aug. 8, 1991 [JP] Japan ..... 3-223466

[51] Int. Cl.[5] ..... B65B 1/04; B65B 3/04

[52] U.S. Cl. ..... 141/100; 141/319; 141/348; 215/DIG. 8; 604/416; 604/88

[58] Field of Search ..... 141/9, 18, 21, 98, 100, 141/346, 351, 348, 349, 319–322, 353, 354, 357; 604/285, 416, 87, 88, 89, 91; 215/364, 353, DIG. 8, 247, 249

[56] References Cited

U.S. PATENT DOCUMENTS

| | | | |
|---|---|---|---|
| 2,364,126 | 12/1944 | Cantor et al. | 215/247 |
| 2,377,274 | 5/1945 | Smith | 604/416 |
| 2,649,245 | 8/1953 | Silverstolpe | 215/364 |
| 3,875,012 | 4/1975 | Dorn et al. | 215/247 |
| 3,932,222 | 1/1976 | Dorn | 195/127 |
| 4,092,546 | 5/1978 | Larrabee | 250/515 |
| 4,234,083 | 11/1980 | Cohen | 206/221 |
| 4,583,971 | 4/1986 | Bocquet et al. | 604/82 |
| 4,614,267 | 9/1986 | Larkin | 206/221 |
| 4,757,911 | 7/1988 | Larkin et al. | 220/265 |
| 4,768,568 | 9/1988 | Fournier et al. | 604/416 |
| 4,886,495 | 12/1989 | Reynolds | 604/416 |
| 4,927,013 | 5/1990 | Brunt et al. | 206/221 |
| 4,936,841 | 6/1990 | Aoki et al. | 604/413 |

FOREIGN PATENT DOCUMENTS

| | | |
|---|---|---|
| 0431779 | 11/1990 | European Pat. Off. . |
| 226506 | 6/1990 | Japan . |
| 3-37067 | 2/1991 | Japan . |

*Primary Examiner*—Henry J. Recla
*Assistant Examiner*—Steven O. Douglas
*Attorney, Agent, or Firm*—Birch, Stewart, Kolasch & Birch

[57] ABSTRACT

A drug vessel suitable for aseptic mixing of a drug with a solvent or diluent and for parenteral administration of the resultant solution, which includes a cylindrical vessel body reduced in diameter at both sides thereof to form a narrow mouth portion at each end, and a seal member to be attached to each mouth portion of the vessel body for sealing the same.

28 Claims, 5 Drawing Sheets

DRUG VESSEL

BACKGROUND OF THE INVENTION

1. Field of the Invention

The present invention relates to a drug vessel and, more particularly, a vessel for holding a drug such as powdered or freeze-dried medicines, which is useful for aseptically mixing the drug contained therein with a solvent or solution and for parenterally administrating the resultant solution to a patient.

2. Description of the Prior Art

In medical facilities such as hospitals, a dose of a medicine is mixed with a solvent or diluent just before use and the resultant solution is intravenously administered to a patient as a fluid therapy. Medicines used for such a purpose are generally supplied in the form of a dry preparation such as powder or freeze-dried preparation and packaged in a vessel or vial because of its poor conservation stability in a liquid state or of any other reasons. In order to dissolve the dry preparation in a solvent or a diluent contained in a liquid container, it is therefore required to connect the medicine vessel or vial to the liquid container by means of a connecting device such as a double ended needle or a connecting tube to transfer the solvent or diluent to the medicine vessel.

However, the procedures are very troublesome and take a long time. In addition, there is a fear of contamination of the medicine contained in the vessel as it is required to make a hole in the medicine vessel in the atmosphere to connect it with the liquid container.

To solve such problems, there have been proposed various drug delivery systems. For example, JP-T- S61-501129, corresponding to U.S. Pat. No. 4,583,971, discloses a closed drug delivery system comprising a flexible container having a liquid diluent therein, a capsule coupled to the flexible container, a drug vial having a drug therein and being supported in the capsule, and a means for coupling the capsule to the interior of the flexible container. In this system, the drug vial is communicated to the flexible container through a communicating means arranged in the coupling means, thus making it possible to aseptically mix the drug with the solvent.

However, this drug delivery system has such a disadvantage that reconstitution of the drug is limited to one drug as the drug vial and diluent container are in a pair.

JP-A- H2-1277, corresponding to U.S. Pat. No. 4,936,841, discloses a device comprising a solvent container having a solvent therein, a capsule having a drug vial therein and adapted to be connected at its connecting portion to a mouth portion of the solvent container, and a communicating means arranged in the connecting portion of the drug vial. In this system, the communicating means is firstly pierced into the drug vial and then pierced into the solvent container to communicate the drug vial to the solvent container, thereby aseptically mixing the drug with the solvent.

JP-A- H3-37067 discloses a drug delivery system comprising a drug vial, a communicating means and a solvent container, all of which are arranged in order, covered and sealed by a synthetic resin sheet. The system further includes a supporting means mounted on the resin sheet and arranged between the drug vial and the container so as to prevent the two vessels from close to each other until aseptic communicating and mixing operations have done.

JP-A- S59-209535, corresponding to U.S. Ser. No. 470,105 and 565,126, discloses a drug delivery system comprising a first flexible vessel having an opening at one end, and a second vessel having a removable stopper and capable of being fixed to the bottom wall of the first vessel therethrough, and a stopper removing means having a portion engaging with the stopper. The drug delivery system may be improved by use of vessels in JP-A- S62-137056 (corresponding to U.S. Ser. No. 806,782) and H2-4375 (corresponding to U.S. Ser. No. 138,810). Improved delivery system is disclosed in JP-B- H2-26506.

However, the drug delivery system of the prior art is complex in structure and the first vessel is limited to a flexible vessel, and that the stopper falls off in the first vessel.

SUMMARY OF THE INVENTION

It is therefore an object of the present invention to provide a drug vessel which is simple in structure and can be used in combination with a solvent container without being limited to a flexible solvent container.

Another object of the present invention is to provide a drug vessel which makes it possible to mix the drug therein with a solvent in the solvent container without causing falling off of the stopper in the solvent container.

The above and other objects of the present invention are achieved by providing a drug vessel comprising a cylindrical vessel body reduced in diameter at both sides thereof to form a narrow mouth portion at each end, and a sealing means attached to each mouth portion of the vessel body for sealing the same.

In a preferred embodiment, at least one of the sealing means comprises a stopper made of rubber. The rubber stopper may have a structure comprising a cylindrical plug portion and an enlarged flange-like head portion integrally connected to one end thereof.

In another preferred embodiment, one of the sealing means comprises an annular packing arranged in the mouth portion of the cylindrical member, a spherical closure member seated on said annular member, and a holder with a through hole to hold said spherical member in place.

In another embodiment, the vessel body is provided with a male screw on the outer periphery of its mouth portion, and a cap is screwed thereon.

According to the present invention, there is also provided a drug transfusion set comprising a drug vessel, and a solvent container assembly adapted to be connected thereto, the vessel comprising a cylindrical vessel body having a narrow mouth portion at either end, and a sealing means attached to each mouth portion for sealing each mouth portion of the vessel body, the solvent container assembly comprising a solvent container closed at one end but opened at the other end and containing a solvent, and a connecting member fixed to the open end of the container.

BRIEF DESCRIPTION OF THE DRAWINGS

These and other objects, features and advantages of the present invention will become apparent from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Figure 1:
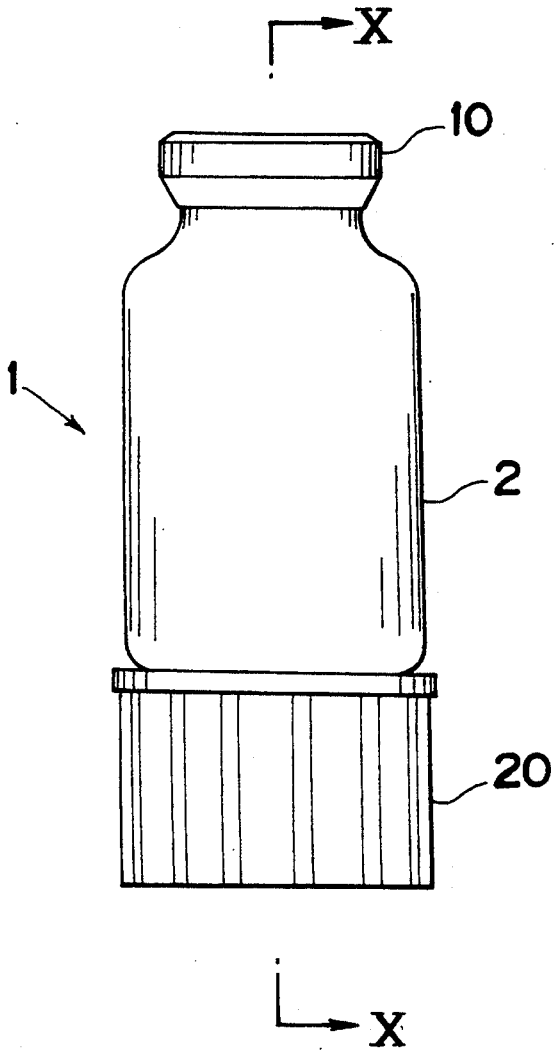
FIG. 1 is a front view of a drug vessel embodying the present invention.
Figure 2:
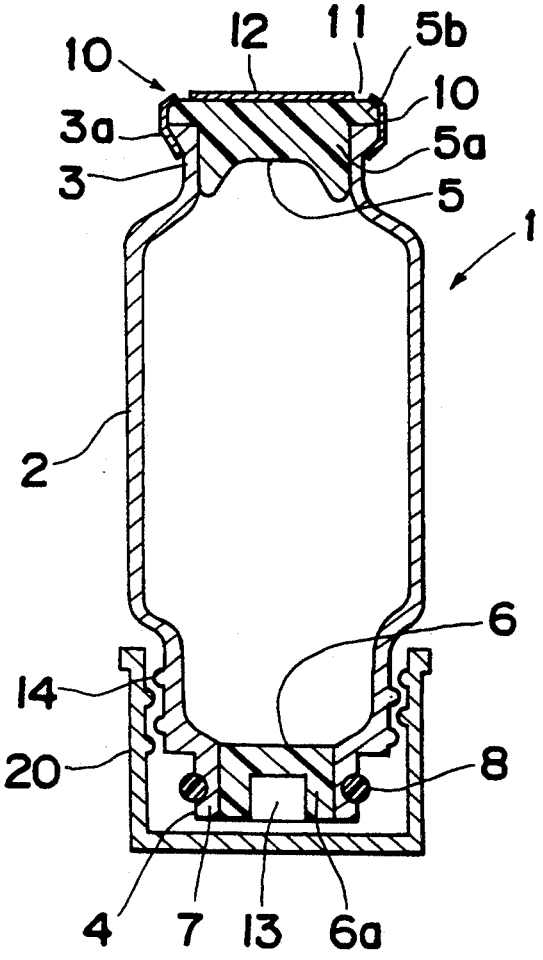
FIG. 2 is a cross-section view of a drug vessel taken along the line X—X in FIG. 1.

Referring now to FIGS. 1 and 2, there is shown a drug vessel, generally designated by 1, according to the present invention. The drug vessel 1 comprises a vessel body 2 having mouth portions 3, 4 at both ends, and sealing members 5, 6 fitted in each mouth portion 3, 4 of the vessel body 2. The drug vessel 1 is further provided with a fixing means such as a clamping member 10 and a removable cap 20 to hold each of the sealing members 5 and 6 in position as well as to insure aseptic handling of the vessel.

The vessel body 2 is generally made of a transparent material such as glass or synthetic resin such as, for example, polypropylene or polyester. The vessel body 2 is partially reduced in diameter at both sides to form a mouth portion 3, 4 at each end. One of the mouth portions, i.e., an upper mouth portion 3 of the vessel body 2, which serves as a drug delivery outlet, is provided with a rib 3*a* on its outer surface close to the open end thereof for engagement with the clamping member 10. The other, lower mouth portion 4 has a male screw 14 provided on the outer periphery thereof. Around the outer surface of the lower mouth portion 4, there is a circumferential groove 7 for receiving a sealing ring 8 which provides sealing engagement with a solvent container mentioned later.

The stopper 5 is generally made of an elastomeric materials. Typical elastomeric material for the stopper 5 include, for example, butyl rubbers, butadiene rubbers and nitrile rubbers. The stopper 5 comprises a plug portion 5*a* with an outside diameter substantially equal to or slightly larger than the inside diameter of the mouth portion 3, and an enlarged flange-like head portion 5*b* integrally connected to the upper end of the plug portion 5*a*.

When the stopper 5 is applied to the vessel body 2, the plug portion 5*a* is fitted in the upper mouth portion 3 of the vessel body 2 so that the enlarged head portion 5*b* comes in close contact with the open end of the mouth portion 3. Then, the clamping member 10 is put on the stopper 5 and applied to the mouth portion 3 of the vessel body 2 to hold the stopper 5 in position as shown in FIG. 2.

The clamping member 10 is generally made of aluminum in the form of a cap-like member having two or more arc-shaped narrow openings 11 cut in the top wall 12 thereof to insure easy removal of the top wall before use.

The stopper 6 for sealing the lower mouth portion 4 is also made of an elastomeric material similar to that of the stopper 5 in the form of a cylindrical member having an outside diameter substantially equal to or slightly larger than the inside diameter of the mouth portion 4. The stopper 6 is provided with a recess 13 in its lower side to provide a means for engagement with an pushing rod of a connecting member mentioned later.

The cap 20 is screwed on the lower mouth portion 4 to protect the stopper 6 and the lower mouth portion 4 of vessel body 2 from contamination with bacteria.

If necessary, the drug vessel 1 may be covered wholly with a plastic sheet or film to keep it in an aseptic condition during transportation and storage.

Figure 4:
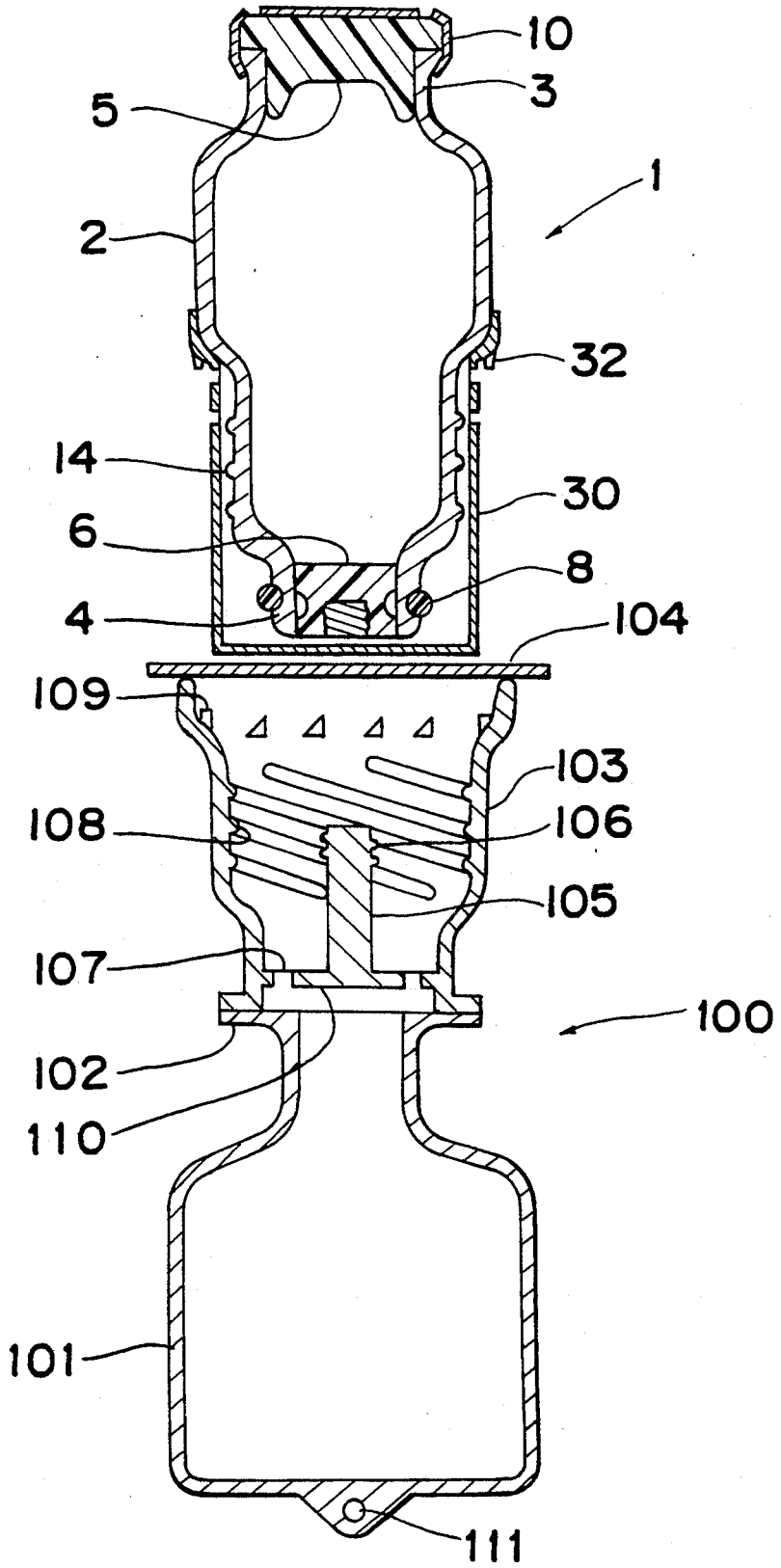
FIG. 4 is a cross-section view showing a drug transfusion set comprising a drug vessel of FIG. 3 and a solvent container to be combined therewith.

To make the drug vessel 1 ready for use, the cap 20 is unscrewed and the lower mouth portion 4 of the vessel 2 is screwed in a solvent container having a structure similar to that of a solvent container assembly 100 shown in FIG. 4. When connecting the container to the vessel, a pushing rod provided in the solvent container is fitted in the recess 13 of the stopper 6, so that the stopper 6 is pushed out from the lower mouth portion of the vessel 1 but held on the pushing rod.

Figure 3:
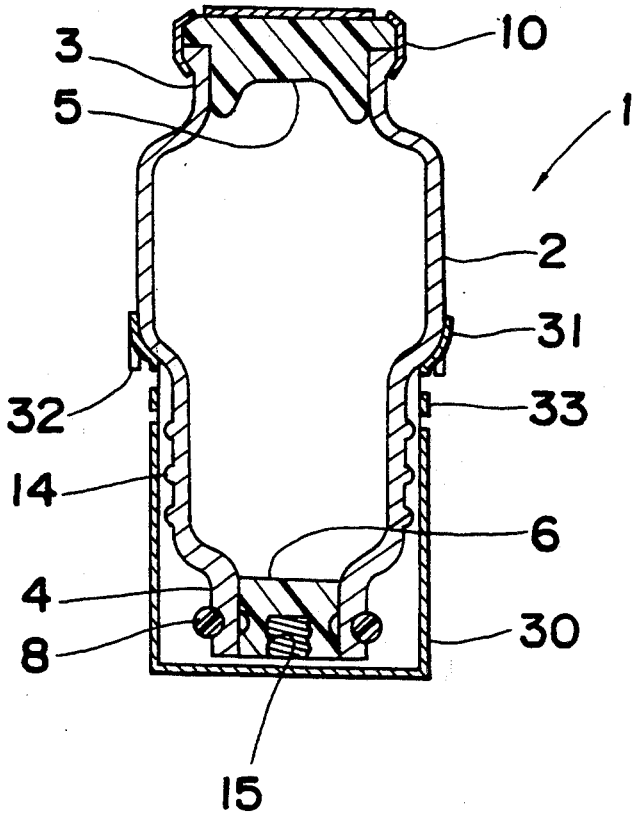
FIG. 3 is a cross-section view similar to FIG. 2, illustrating another embodiment of the drug vessel according to the present invention.

Referring now to FIG. 3, there is shown a drug vessel 1 having a construction similar to that of the drug vessel shown in FIGS. 1 and 2. In this embodiment, a cylindrical vessel body 2 has a narrow mouth portion 3, 4 at each side. The stopper 6 has a threaded recess 15 and is fitted in the lower mouth portion 4 of the vessel body 2. The lower mouth portion of the vessel body 2 has a large-sized portion and this large-sized portion is provided with a male screw 14 for engagement with a solvent container assembly mentioned later.

The cap 30 is a bottom-closed cylindrical member and is partially enlarged in diameter on the upper side thereof to form an enlarged portion or a skirt 31, at which the cap 30 is fixed to the vessel body 2. The skirt 31 is provided at its lower end with projections 32 to prevent the solvent container from looseness of the screw connection with the vessel. The projections 32 extend downwardly and are spaced equally around the circumference of the skirt 31. Immediately adjacent the skirt 32, the cap 30 is provided with a circumferential weakened part 33 so that the cap 30 can be twisted off easily by turning it, while leaving the skirt 31 on the vessel 2.

Figure 5:
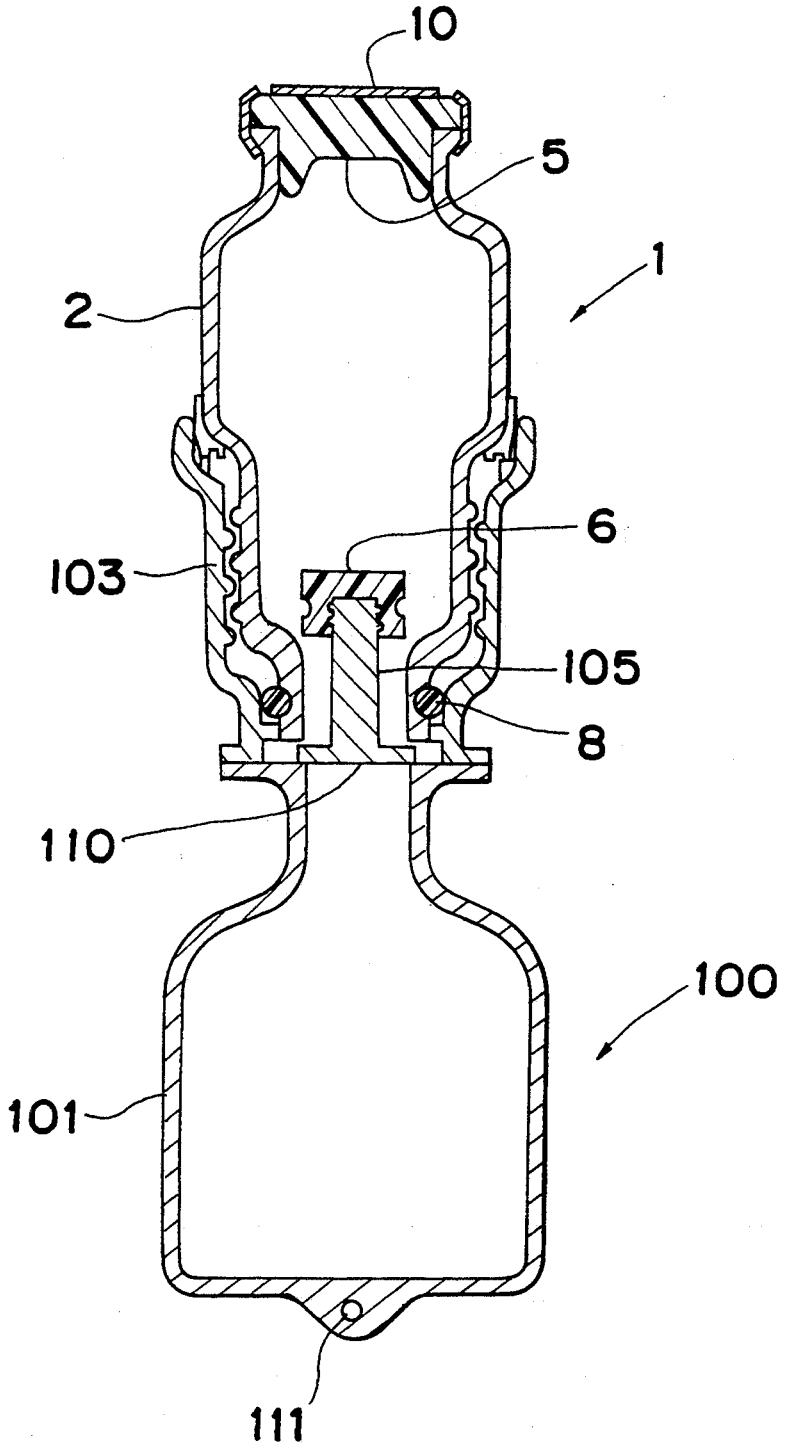
FIG. 5 is a cross-sectional view similar to FIG. 4, but the drug vessel being combined with the solvent container.

The above drug vessel 1 may be used in combination with a solvent container assembly 100 as shown in FIGS. 4 and 5.

Referring now to FIGS. 4 and 5, there is shown a drug transfusion set comprising a drug vessel 1 of FIG. 3 and a solvent container assembly 100. The assembly 100 comprises a solvent container 101 containing a dose of a solvent or diluent, a connecting member 103, and a sealing member 104 for sealing an open end of the connecting member 103.

The connecting member 103 has a bore corresponding to the configuration of the lower half of the drug vessel 1 and having a female screw 108 to be engaged with the male screw of the drug vessel 1. The connecting member 103 is fixed at its flanged lower end to the flange 102 of the container 101 and is closed by a partition wall 110 integrally connected thereto near the flanged lower end thereof. The partition wall 110 has a pushing rod 105 coaxially extending in the direction toward the open end of the connecting member 103 and having a male screw 106 at its free end. Also, the partition wall 110 has an annular weakened portion 107 formed coaxially with the pushing rod 105 to allow the partition wall 110 to be easily broken by the mouth portion 4 of the vessel 1 when the container 100 is screwed thereon.

The partition wall 110 is provided in its both sides with several grooves (not shown) radially extending from the base of the pushing rod 105 towards the weakened portion 107 to form passages for the solvent when the partition wall 110 is pressed against the flange 102 of the container 101 by the vessel 1. The connecting member 103 is further provided with a plurality of projections 109 adapted to be engaged with the projections 32 of the skirt 31 remaining on the cap 30. The upper open end of the connecting member 103 is sealed by a suitable sealing means such as, for example, a laminated film 104 of aluminum foil with polyester as the external layers.

To make the drug vessel 1 ready for use, the cap 30 is twisted off by turning it clockwise or counterclockwise, while leaving the skirt 31 on the vessel 2. On the other hand, the laminated film 104 of the solvent container assembly 100 is peeled off from the connecting member 103.

Then, the connecting member 103 is screwed on the large-sized portion of the mouth portion 4. During this course, the pushing rod 106 of the connecting member 103 is screwed in the threaded recess 15 of the stopper 6. Then, the partition wall 110 is brought into contact with the open end of lower mouth portion 4 of the vessel body 2, broken at 107 and forced to the flange 102 of the solvent container 101, as shown in FIG. 5. At the same time, the stopper 6 is pushed out from the lower mouth portion 4 of the vessel body 2 and the drug vessel 1 is communicated with the interior of the solvent container 101 through the grooves formed in the partition wall 110. Also, the clearance formed between the lower mouth portion 4 and the inside wall of the connecting member 103 near the partition wall 110 is sealed by the sealing ring 8 of the vessel body 2. Since the stopper 6 is screwed on the pushing rod 105, it does not fall into the drug vessel 1.

The assembled drug transfusion set is turned upside down to allow the solvent in the container 101 to flow into the drug vessel 1 through the grooves in the partition wall 110, shaken to prepare a homogeneous drug solution, and then suspended at 111 of the solvent container 101 with a suspending means (not shown). After peeling off the clamping member 10 from the mouth portion 3 of the vessel 1 to expose the stopper 5, the stopper 5 is pierced by a hollow needle of a solution infusion set to perform an intravenous drip infusion.

Accordingly, using the drug vessel of the present invention there is provided a cheap drug transfusion set which is simple in structure and makes it possible to achieve aseptic administering operations. Further, since the drug vessel of the present invention can be introduced to air by piercing an airway needle, or a hollow needle with an air filter, into the stopper arranged in the upper mouth portion thereof, the solvent container to be combined with the drug vessel is never limited to flexible containers. In addition, the use of the drug vessel of the present invention sets a patient at ease as the stopper is prevented from falling into the drug vessel and held on the pushing rod of the connecting member.

Figure 6:
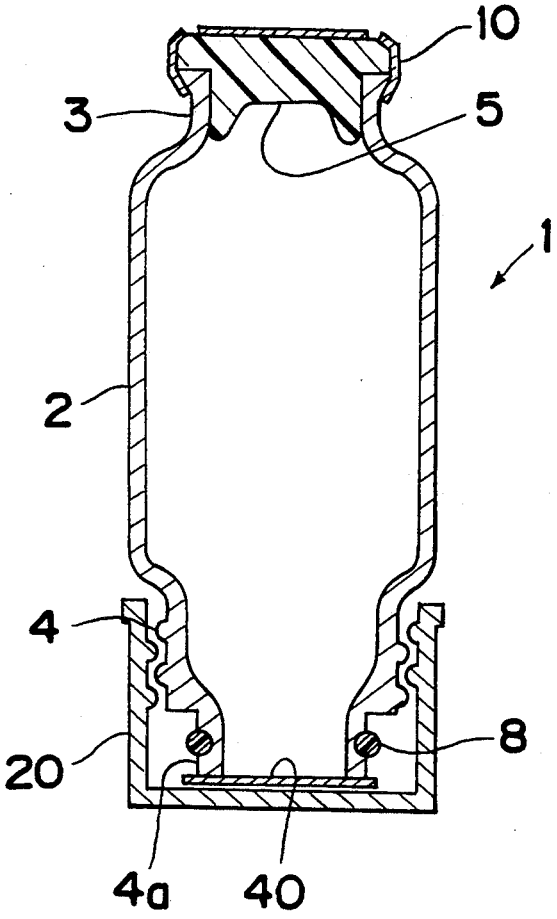
FIG. 6 is a cross-section view similar to FIG. 2, illustrating further embodiment of the drug vessel according to the present invention.
Figure 7:
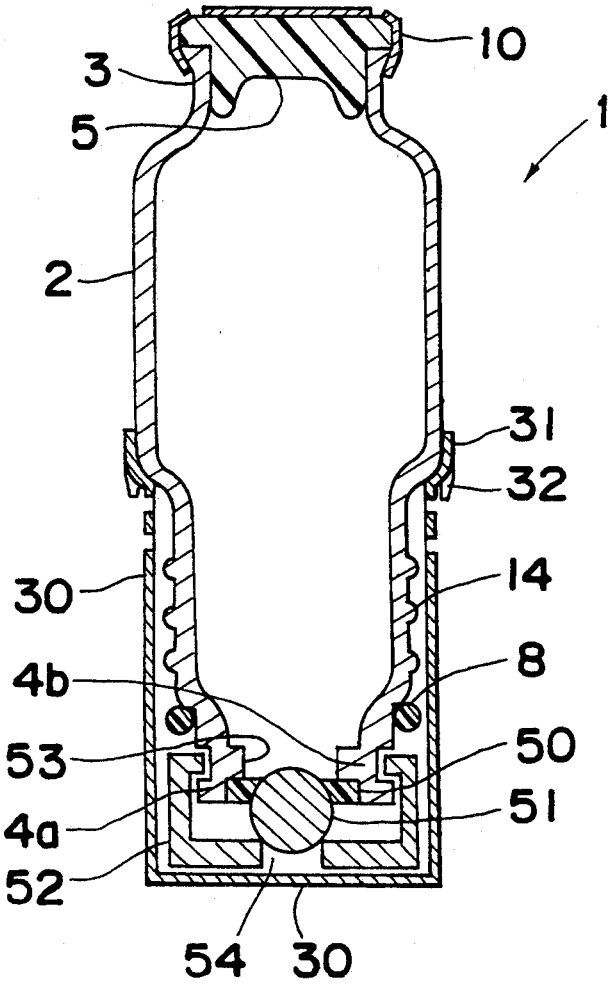
FIG. 7 is a cross-section view similar to FIG. 2, illustrating still another embodiment of the drug vessel according to the present invention.

In the above embodiments, the mouth portions 3 and 4 of the vessel body 2 are sealed by the stoppers 5 and 6, but they may be sealed by any other sealing means, for example, as shown in FIGS. 6 and 7.

Referring now to FIG. 6, there is shown another embodiment of a drug vessel 1 having the same structure as that of the drug vessel shown in FIG. 2, except that a laminated film 40 is used as a means for sealing the lower mouth portion 4 of the vessel body 2 in place of the rubber stopper 6.

The laminated film 40 generally used are plastic laminates consisting of two or three layers bonded together with adhesive except for special cases. It is however preferred to use a laminated film consisting of an aluminum foil sheet with polyester as the external layers because of its good gas-barrier properties. The laminated film 40 is generally fixed to the open end of the mouth portion 4 of the drug vessel 2 with a suitable bonding agent.

In use, the cap 20 is unscrewed and a solvent container is screwed on the drug vessel 1. During connecting the solvent container to the vessel, a hollow needle arranged in the mouth portion of the container is pierced into the laminated film 40 so that the drug vessel 1 is communicated with the interior of the solvent container.

In the embodiment shown in FIG. 7, the lower mouth portion 4 of the vessel body 2 is sealed by a sealing means comprising a ring-like packing 50, a spherical closure member 51 rested on the packing 50, and a holder 52. To this end, the vessel body 2 is provided with an annular projection 53 on an inside of the cylindrical extended portion **4*a* thereof to provide a seat for the packing 50, and with an annular groove 4*b* around the outer surface of the cylindrical extended portion 4*a* thereof to provide a means for fitting the holder 52** thereon.

The spherical closure member 51 has an outside diameter smaller than an inside diameter of the annular projection 53 but greater than the diameter of the bore of the packing 50. The spherical closure member 51 is generally made of glass or a synthetic resin. However, any other material may be used for the spherical closure member 51, provided that it has a good chemical-resistance and provides a smooth surface. This closure member 51 may be used in combination with a thick cylindrical packing having a spherical bore therein for receiving the spherical closure member.

The packing 50 is made of an elastomeric material in the form of a ring having a bore which has a diameter smaller than that of the spherical closure member 51. Typical elastomeric material includes, without being limited to, butyl rubber, styrene-butadiene rubber, isoprene rubber, urethane rubber, and nitrile rubber.

The holder 52 is snapped onto the cylindrical extended portion **4*a* of the lower mouth portion 4 of the vessel body 2 to hold the closure member 51 in position. The holder 52 has a bore 54** at its central part for insertion of the pushing rod of the solvent container.

The cap 30 is enlarged in diameter at the open end thereof to form a skirt 31, by which the cap 30 is fixed to the vessel body 2. The skirt 31 is provided at its lower end with downwardly extending projections or clicks 32 spaced equally round the circumference to prevent the solvent container from rotation in the direction allowing looseness of the screw connection with the vessel.

The drug vessel 1 of FIG. 7 may be used in combination with a solvent container assembly having a structure similar to that of the solvent container assembly 100 shown in FIG. 4. In this case, the drug vessel 1 is communicated with the solvent container by twisting off the cap 30 from the drug vessel 1 and then the connecting member of the container is screwed on the large-sized portion of the lower mouth portion 4. During this course, the spherical closure member 51 is forced into the drug vessel 1 through the packing 50 by an pushing rod similar to the pushing rod 106 of the connecting member 103.

Although the present invention has been fully described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims unless they depart therefrom.

What is claimed is:

1. A drug vessel for use in combination with a solvent containers, comprising:

a cylindrical vessel body having upper and lower mouth portions reduced in diameter, said lower mouth portion being provided on its outer periphery with a male screw thread for complementary engagement with a solvent container and a circumferential groove for receiving a sealing ring;

upper and lower sealing members for closing said upper and lower mouth portions, said lower sealing member being provided in its lower end with a recess for engagement with a pushing rod of a solvent container; to prevent the lower sealing member from falling into the solvent container upon engagement of said vessel with said container;

clamping means for retaining said upper sealing member within the vessel and for keeping said upper mouth portion in an aseptic condition; and a cap removably attached to said lower mouth for keeping said lower mouth portion in an aseptic condition.

2. The drug vessel according to claim 1, wherein at least one of said sealing members comprises a rubber stopper.

3. The drug vessel according to claim 1, wherein said cap is screwed onto at least the lower mouth portion of said vessel body.

4. The drug vessel according to claim 1, wherein said drug vessel is covered with a synthetic sheet.

5. The drug vessel according to claim 1, wherein one of said sealing members comprise a rubber stopper having a cylindrical plug portion and an enlarged flange-like head portion integrally connected to one end thereof and wherein the other sealing member comprises a rubber stopper having a cylindrical plug portion with a central recess.

6. The drug vessel according to claim 1, wherein said upper sealing member comprises a rubber stopper.

7. The drug vessel according to claim 6, wherein said upper rubber stopper is composed of a cylindrical plug portion and an enlarged flange-like head portion.

8. The drug vessel according to claim 1, wherein said lower sealing member is composed of a rubber stopper.

9. The drug vessel according to claim 1, wherein the recess of said lower sealing member is a cylindrical recess.

10. The drug vessel according to claim 1, wherein the recess of said lower sealing member is a threaded recess.

11. The drug vessel according to claim 1, wherein said clamping means is comprised of aluminum in the form of a cap-like member having two or more arc-shaped narrow openings.

12. The drug vessel according to claim 1, wherein said cap is screw-mounted on the lower mouth portion of said vessel body.

13. The drug vessel according to claim 1, wherein said cap is a bottom-closed cylindrical member having an enlarged portion at the upper side thereof and being fixed to said vessel body at said enlarged portion.

14. The drug vessel according to claim 13, wherein the enlarged portion of said cap is provided with projections extending downward.

15. The drug vessel according to claim 13, wherein said cap is provided with a circumferential weakened part immediately adjacent to said enlarged portion so that the cap can be twisted off easily by turning it, while leaving the enlarged portion on the vessel.

16. The drug vessel according to claim 1, wherein said drug vessel is wholly covered with a synthetic sheet.

17. A drug transfusion set comprising a drug vessel and a solvent container assembly adapted to be connected to said drug vessel, said drug vessel comprising a cylindrical vessel body having upper and lower mouth portions reduced in diameter, said lower mouth portion being provided on its outer periphery with a male screw thread for complementary engagement with a solvent container and having a circumferential groove for receiving a sealing ring, upper and lower sealing members for closing said upper and lower mouth portions, said lower sealing member being provided in its lower end with a recess for engagement with a pushing rod of a solvent container to prevent the lower sealing member from falling in the solvent container, clamping means for retaining said upper sealing member and for keeping said upper mouth portion in an aseptic condition, and a cap removably attached to said lower mouth for keeping said lower mouth portion in an aseptic condition, said solvent container comprising a closed end and an open end and a connecting member fixed to the open end of the container, the open end of said solvent container being closed by said connecting member.

18. The drug transfusion set according to claim 17, wherein said cap is a bottom-closed cylindrical member having an enlarged portion at the upper side thereof and being fixed to said vessel body at said enlarged portion.

19. The drug transfusion set according to claim 18, wherein the enlarged portion of said cap is provided with projections extending downward.

20. The drug transfusion set according to claim 19, wherein said connecting member is provided with a plurality of projections adapted to be engaged with the projections of the enlarged portion of said cap.

21. The drug transfusion set according to claim 18, wherein said cap is provided with a circumferential weakened part immediately adjacent to said enlarged portion so that the cap can be twisted off easily by turning it, while leaving the enlarged portion on the vessel.

22. The drug transfusion set according to claim 17, wherein said connecting member has a bore corresponding to a configuration of the lower half of the drug vessel and having a female screw thread for complementary engagement with the male thread of said drug vessel.

23. The drug transfusion set according to claim 17, wherein said connecting member has a partition wall having a push rod integrally formed therewith, said partition wall being arranged near a lower end of said connecting member, said push rod being formed coaxially with respect to the center axis of the connecting member and extending in the direction toward the open end of the connecting member.

24. The drug transfusion set according to claim 23, wherein said push rod is adapted to be fitted in the recess of said lower sealing member.

25. The drug transfusion set according to claim 23, wherein said push rod is provided with a male screw at a free end thereof and adapted to be screwed in the threaded recess of said lower sealing member.

26. The drug transfusion set according to claim 23, wherein said partition wall has an annular weakened portion formed coaxially with the pushing rod to allow the partition wall to be easily broken by the lower mouth portion of the drug vessel.

27. The drug transfusion set according to claim 26, wherein said partition wall is provided in its both sides with several grooves radially extending from the base of said pushing rod towards the weakened portion to form passages for the solvent when the partition wall is pressed against the open end of the solvent container.

28. The drug transfusion set according to claim 17, wherein the upper open end of the connecting member is sealed by a laminated film.

* * * * *